US006669993B2

(12) United States Patent
Tam et al.

(10) Patent No.: US 6,669,993 B2
(45) Date of Patent: Dec. 30, 2003

(54) HIGH SPEED YARN FINISH APPLICATION

(75) Inventors: Thomas Yui-Tai Tam, Richmond, VA (US); Jeffrey T. Perkins, Richmond, VA (US); Qiang Zhou, Midlothian, VA (US); Arlin L. Fynaardt, Midlothian, VA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/941,281

(22) Filed: Aug. 28, 2001

(65) Prior Publication Data

US 2002/0056178 A1 May 16, 2002

Related U.S. Application Data

(60) Provisional application No. 60/233,681, filed on Sep. 19, 2000.

(51) Int. Cl.[7] ..... B05D 1/18

(52) U.S. Cl. ..... 427/434.7; 427/434.4; 427/434.5; 118/405

(58) Field of Search ..... 427/434.7, 434.2, 427/434.4, 434.5, 434.6, 175; 118/405; 28/217; 264/130, 211.14; 68/200

(56) References Cited

U.S. PATENT DOCUMENTS

| | | | | |
|---|---|---|---|---|
| 2,294,870 A | | 9/1942 | Kline et al. | 18/8 |
| 3,172,780 A | | 3/1965 | Csok et al. | 118/50 |
| 3,244,142 A | | 4/1966 | Walker | 118/123 |
| 3,485,210 A | * | 12/1969 | Warren | 118/420 |
| 3,754,530 A | | 8/1973 | Pierce | 118/420 |
| 3,988,086 A | | 10/1976 | Marshall et al. | 425/72 S |
| 4,054,634 A | | 10/1977 | Marshall et al. | 264/210 |
| 4,253,416 A | | 3/1981 | Williams, Jr. | 118/401 |
| 4,255,472 A | | 3/1981 | Williams, Jr. | 427/445 |
| 4,255,473 A | | 3/1981 | Williams, Jr. | 427/445 |
| 4,268,550 A | | 5/1981 | Williams, Jr. | 427/429 |
| 4,325,322 A | | 4/1982 | Louch et al. | 118/410 |
| 4,329,750 A | | 5/1982 | Binnersley | 8/151.2 |
| 4,397,164 A | | 8/1983 | Binnersley | 68/200 |
| 4,397,985 A | | 8/1983 | Marshall et al. | 524/837 |
| 4,526,808 A | | 7/1985 | Strohmaier | 427/565 |
| 4,544,579 A | * | 10/1985 | Mullins et al. | 427/175 |
| 4,565,154 A | | 1/1986 | Mullins et al. | 118/410 |
| 4,617,236 A | | 10/1986 | Marshall | 428/391 |
| H153 H | | 11/1986 | Sadler et al. | 427/57 |
| 4,675,142 A | | 6/1987 | D'Andolfo et al. | 264/103 |
| 4,851,172 A | | 7/1989 | Rowan et al. | 264/130 |
| 4,855,099 A | | 8/1989 | D'Andolfo et al. | 264/103 |

(List continued on next page.)

FOREIGN PATENT DOCUMENTS

| | | |
|---|---|---|
| DD | 122108 | 9/1976 |
| DD | 292276 | 7/1991 |
| DE | 19945699 | 6/2000 |
| EP | 0 195 156 | 9/1986 |
| JP | 60194107 | 2/1985 |

OTHER PUBLICATIONS

B.C. Sakiadis, "Boundary Layer Behavior on Continuous Solid Surfaces", A.I.Ch.E. Journal, vol. 7, Nos. 1,2 & 3, pp. 26–28, 221–225,467–472 (1961) (No month date).

*Primary Examiner*—Katherine A. Bareford
(74) *Attorney, Agent, or Firm*—Virginia Szigeti; Margaret S. Millikin

(57) ABSTRACT

Methods and devices to actively apply finish to one or more yarns in motion at speeds greater than about 3000 m/min, to achieve a finish application of 0.2 wt % or more with a coefficent of variation of finish concentration of 10% or less, and the finished yarns so produced. The devices are compact, portable and readily installed at a variety of positions on a fiber processing line, such as between heated godet rolls. The devices contain the finish so that contamination of the surrounding areas is prevented. The yarn products of the invention may be used in textile and leisure fiber applications and in industrial fiber applications, such as tires.

38 Claims, 5 Drawing Sheets

U.S. PATENT DOCUMENTS

| | | | | | |
|---|---|---|---|---|---|
| 4,891,960 | A | | 1/1990 | Shah | 68/200 |
| 4,902,461 | A | * | 2/1990 | Schippers | 264/103 |
| 4,984,440 | A | | 1/1991 | McCall | 68/200 |
| 5,181,400 | A | | 1/1993 | Hodan | 68/200 |
| 5,287,606 | A | * | 2/1994 | Ruef | 28/219 |
| 5,562,988 | A | | 10/1996 | Anderson et al. | 428/395 |
| 5,624,715 | A | | 4/1997 | Gueggi et al. | 427/420 |
| 5,679,158 | A | | 10/1997 | Holzer, Jr. et al. | 118/407 |
| 6,067,928 | A | | 5/2000 | Holzer, Jr. et al. | 118/33 |
| 6,146,690 | A | | 11/2000 | Kustermann | 427/78 |
| 6,248,407 | B1 | | 6/2001 | Hess | 427/426 |

* cited by examiner

HIGH SPEED YARN FINISH APPLICATION

CROSS-REFERENCE TO RELATED APPLICATIONS

This application claims the benefit of provisional application Ser. No. 60/233,681 filed Sep. 19, 2000, entitled "Overfinish Application, Process, Apparatus and Product".

BACKGROUND OF THE INVENTION

1. Field of the Invention

The present invention relates to methods and devices for applying finish to yarns in motion at high speeds of about 3000 meters per minute (m/min) or greater, and to the products formed thereby.

2. Description of the Related Art

Liquid finishes are typically complex mixtures of water, oils, polymers, and surfactants applied to yarns to achieve desired processability characteristics including lubricity and reduction of static electricity, and to improve end use properties. For some applications, such as tire cord yarns, more than one finish, is applied. A first finish is applied to facilitate drawing operations during yarn manufacture. A second finish or overfinish is applied to aid in bonding the yarn to rubber during tire construction.

The function of a finish applicator device is to apply finish at an even rate to a travelling yarn so that the filaments of the yarn are evenly coated with the finish. Conventionally, yarn finishes are applied by advancing a running yarn threadline in contact with the surface of a "kiss roll" rotated in a liquid reservoir containing the desired finish, or by means of applicator tips or sprays.

As used herein, "active finish application" refers to a method by which finish is supplied to the yarn using force, such as pressure or injection. The finish may be applied by impingement of a jet under pressure or by full immersion under pressure. Active finish application is in contrast to the prior art methods which are herein termed passive wherein the finish is provided at about atmospheric pressure on a roll or applicator tip and the yarn picks up some finish as it passes through a film of finish. As used herein, pressure means the highest pressure at the finish-yarn interface along the yarn path through an applicator device.

Prior art finish applicators are described for example in U.S. Pat. No. 2,294,870 to Kline et al.; U.S. Pat. No. 3,244,142 to Walker; U.S. Pat. No. 3,754,530 to Pierce; U.S. Pat. No. 3,988,086 to Marshall et al.; U.S. Pat. No. 4,325,322 to Louch et al.; U.S. Pat. No. 4,329,750 and U.S. Pat. No. 4,397,164 to Binnersley; U.S. Pat. No. 4,526,808 to Strohmaier; U.S. Pat. No. 4,544,579 and U.S. Pat. No. 4,565,154 to Mullins et al; U.S. Pat. No. 4,851,172 to Rowan et al.; U.S. Pat. No. 4,891,960 to Shah; U.S. Pat. No. 4,984,440 to McCall; U.S. Pat. No. 5,181,400 to Hodan; U.S. Pat. No. 5,679,158 and U.S. Pat. No. 6,067,928 to Holzer, Jr. et al.; United States Statutory Invention Registration H153 to Sadler et al.; and DD 122,108 to Henssler. However, difficulties with these devices arise when yarn speeds increase to about 3000 m/min or even less. In none of these devices was there an attempt to disengage or block an air boundary layer in motion with the yarn.

A running thread line entrains a boundary layer of the fluid, air or liquid, through which it passes. The boundary layer of fluid moves at the speed of the thread line at its surface. The mechanics of boundary layers have been analyzed most notably by H. Schlichting, *Boundary Layer Theory*, McGraw Hill, N.Y., 1960 and in the context of moving continuous surfaces by B. C. Sakiadis, *A.I.Ch.E. Journal,* 7(1,2 & 3), 26–28, 221–225, 467–472 (1961). A thread line moving at high speed in air, when brought into contact with a liquid, creates a violent turbulence at the intersection where the air boundary layer in motion with the thread line impinges on the liquid. In the context of application of liquid finishes to high speed running yarns by conventional kiss rolls and applicators, the air boundary layer limits the concentration of finish that is applied to the yarn, causes large variation in finish pickup and creates excessive spraying of finish to surrounding areas.

Prior art attempts to resolve these problems have been described for example in U.S. Pat. Nos. 4,253,416, 4,255,472, 4,255,473 and 4,268,550 to Williiams Jr.; and U.S. Pat. Nos. 4,675,142 and 4,855,099 to D'Andolfo et al.

EP 0195 156 A2 describes spinning and applying finish to yarns at speeds of about 4000 m/min by means of spray nozzles.

The disclosures of Williams Jr. attempt to ameliorate the effect of the air boundary layer on the finish supply without actually interrupting the air boundary layer. These disclosures qualitatively describe more uniform finish application by the patented devices but no quantitative information is provided regarding the concentration of finish on the yarn or the finish uniformity.

U.S. Pat. Nos. 4,675,142 and 4,855,099 to D'Andolfo et al. apply finish to the yarn by means of opposing spray nozzles. No attempt is made in D'Andolfo et al. to influence the air boundary layer prior to finish application. Instead, the excess finish sprayed from the yarn is captured in large fixed enclosures. In U.S. Pat. No. 4,675,142 finish concentrations on the yarn up to 1.36% by weight are reported but finish concentrations varied by 15% to 35% of the average value.

In a different area, U.S. Pat. No. 5,624,715 to Gueggi et al.; U.S. Pat. No. 6,146,690 to Kustermann; and U.S. Pat. No. 6,248,407 B1 to Hess describe methods of applying a coating to a moving planar surface involving interruption of the air boundary layer in motion with the surface.

A need exists for finish applicator devices capable of actively applying finish to one or more yarns running at speeds over 3000 m/min, uniformly and at sufficient concentrations. A further need is for these devices to contain the finish and prevent spraying and contamination of surrounding areas. A yet further need is for these devices to be small, portable and easily installed at a variety of positions on a fiber processing line.

In the manufacture of yarns for in-rubber applications, such as tires belts and hoses, it is necessary to apply an overfinish to facilitate bonding of the yarn to rubber. It appears to be an invariable practice to apply the overfinish after the yarn is drawn and immediately before winding. See for example U.S. Pat. No. 5,562,988. This practice results in winding a wet yarn where the finish can pool and cause subsequent variations in rubber adhesion. A need exists for a finish applicator device that may be placed in a position between heated rolls on a yarn draw panel to permit drying the overfinish before winding.

SUMMARY OF THE INVENTION

The invention provides methods and devices to actively apply finish to one or more yarns in motion at speeds greater than about 3000 m/min, to achieve a finish application of 0.2 wt. % or more, and with a coefficient of variation of finish concentration of 10% or less. The devices are compact, portable and readily installed at a variety of positions on a fiber processing line. The devices of the invention contain the finish so that contamination of the surrounding areas is prevented.

The devices may be used to provide an overfinish to a moving yarn between heated godet rolls. The so-provided heating may be used to dry the yarn and to promote curing reactions in the finish and between the yarn and finish compounds. As used herein, "curing" refers to any reaction, which may be accelerated by heat. Non-limiting examples include crosslinking reactions and polymerization reactions. Such curing reactions may serve to enhance properties of the yarn. Non-limiting examples of such enhanced properties are adhesion to rubber, fatigue resistance and cohesion.

In one embodiment, the invention is a method for applying a liquid finish to one or more running yarns at speeds greater than 3000 m/min comprising the steps of:

a) passing the yarns into a finish applicator device while substantially blocking the entry of the air boundary layers in motion with the yarns into said finish applicator device;

b) contacting the yarns with a liquid finish under pressure;

c) substantially disengaging the excess finish from the yarns; and d) passing the yarns out of the applicator device.

In another embodiment, the invention is a method for applying a liquid finish to one or more running yarns at speeds greater than 3000 m/min comprising the steps of:

a) passing one or more running yarns into an finish applicator device;

b) substantially blocking and disengaging the air boundary layer in motion with each yarn and venting it to the exterior of said finish applicator device;

c) contacting the yarns with a liquid finish under pressure;

d) substantially disengaging the excess finish from the yarns; and e) passing the yarns out of the applicator device.

The invention also includes a yarn manufacturing method comprising the steps of: applying a liquid finish to one or more yarns running at speeds greater than about 3000 m/min at a position between heated rolls on a draw panel; drying said finish between said rolls; and collecting a dry drawn yarn on a winder.

The invention further includes the devices utilized in the above methods. In one embodiment termed an "immersion applicator", the invention is a device for applying a liquid finish to one or more high speed running yarns comprising an essentially box-like device having yarn entry openings constricted to substantially block entrance of the air boundary layer entrained by each yarn. The device is internally divided into two or more chambers along the yarn path connected by constricted passages. In at least one of these chambers, the yarn is contacted with finish liquid under pressure. Excess finish liquid is captured and drained from one or more succeeding chambers.

In another embodiment termed a "slotted applicator", the invention is a device for applying a finish liquid to one or more high speed running yarns utilizing an essentially box-like device having yarn entry openings and ducts behind the yarn entry openings to divert and discharge the air boundary layers at the lateral surfaces of the device. Within the device, one or more pressurized jets of finish liquid impinge on the yarns traveling in a channel. Excess finish liquid is captured and drained from one or more internal downstream chambers.

The invention also includes the finished yarn products so produced. A yarn with improved finish uniformity is provided with an overfinish actively applied and dried on the draw bench before the first winding operation. The yarn products of the invention may be used in textile and leisure fiber applications, and in industrial fiber applications, such as in tires.

DETAILED DESCRIPTION OF THE INVENTION

Figure 1:
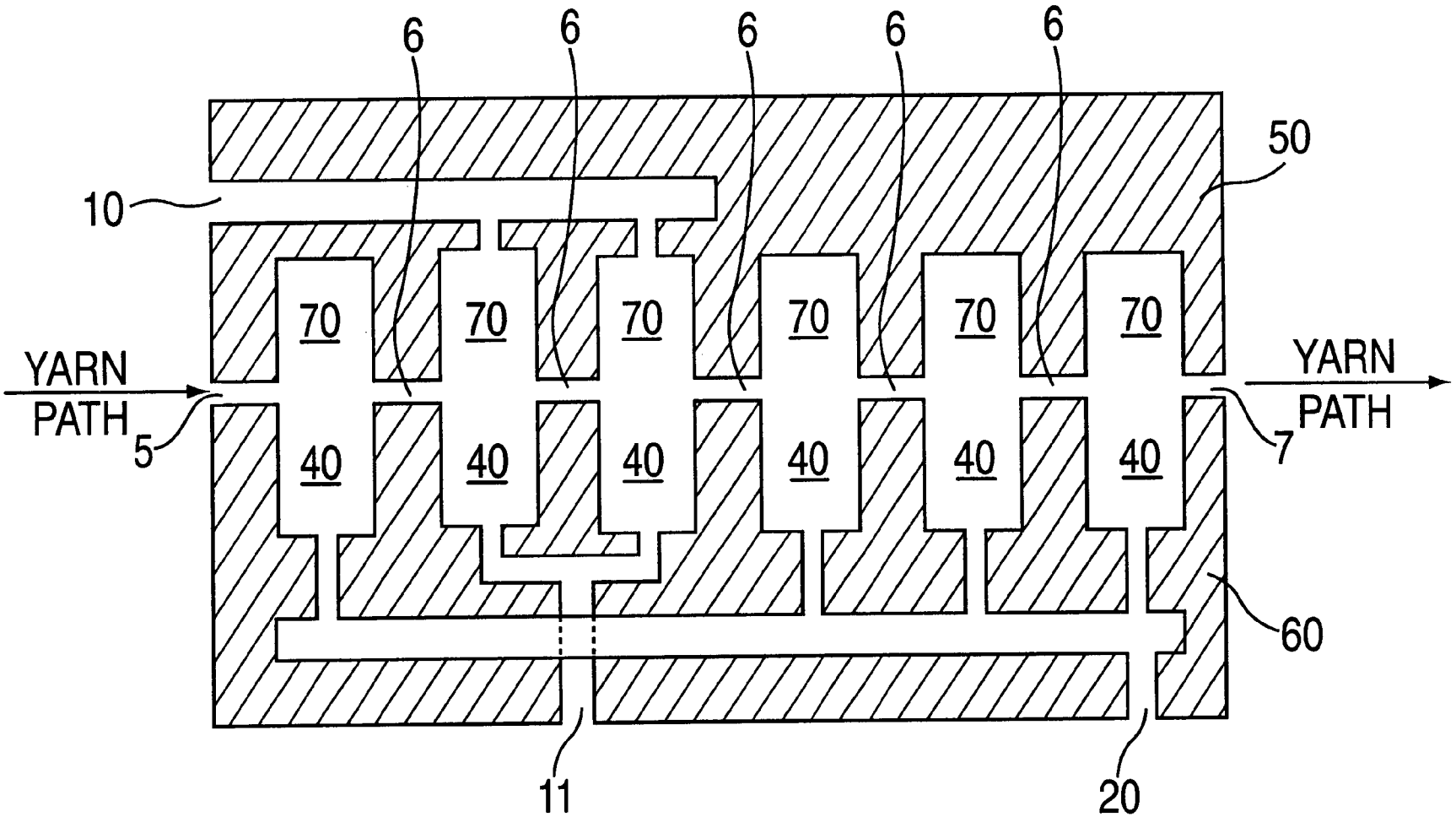
FIG. 1 shows a sectional sketch of a first finish applicator of the invention termed an "immersion applicator".

While the invention will be described with reference to the treatment of yarn, it should be understood that the invention can be used to treat, in single filaments or bundles of filaments, any type of yarn, string or thread. Similarly, while the invention will be described in terms of a finish, it would be understood that the invention can be used to treat yarn with a wide variety of treatment agents, such as for example, coatings of various types, dyes and chemical treatments.

The invention provides methods and devices to actively apply finish and/or overfinish to one or more yarns in motion at speeds greater than about 3000 m/min, to achieve 0.2 wt. % or more of finish application on the yarns, and with a coefficient of variation of finish concentration of 10% or less. As used herein throughout, finish concentrations are expressed as finish weight divided by the sum of finish weight and yarn weight. The methods and devices are also suitable to achieve 0.2 wt. % or more of finish application on one or more yarns with a coefficient of finish concentration of 10% or less at yarn speeds greater than about 5000 m/min and greater than about 8000 m/min.

In a first embodiment, the invention is a method for applying a liquid finish to one or running yarns at speeds greater than 3000 m/min comprising the steps of: passing the yarns into a finish applicator device while substantially blocking the entry of the air boundary layers in motion with the yarns into said finish applicator device; contacting the yarns with a liquid finish under pressure; substantially disengaging the excess finish from the yarns; and passing the yarns out of the applicator device.

For the purposes of each embodiment of this invention, the pressures at the finish/yarn interface are obtained from finite element analysis using the software designated CFDesign obtained from Blueridge Numerics Inc., Charlottesville, Va. For the purposes of the invention, such analysis is based on one phase flow of a liquid having a viscosity and density dependent only on temperature.

In one realization of the first embodiment a liquid finish is applied to one or more high speed running yarns utilizing an essentially box-like device having yarn entry openings constricted to substantially block entrance of the air boundary layer entrained by each yarn. The device is internally divided into two or more chambers along the yarn path connected by constricted passages. At least one of these chambers is positively fed with liquid finish. The yarn is contacted with the finish liquid under pressure. Excess finish liquid is captured and drained from one or more succeeding chambers.

More specifically, in this realization, the invention is a method for applying a liquid finish to running yarns at speeds greater than 3000 m/min as follows:

One or more running yarns is passed into a first chamber of an applicator device through constricted yarn entry openings that substantially block the air boundary layer entrained by each yarn.

A yarn passes from the first chamber through a constricted yarn passage into second and sequential chambers further connected by constricted yarn passages.

Liquid finish is positively fed from an external source to at least one of the chambers traversed by each yarn.

Each yarn is contacted with the liquid finish under pressure.

Excess finish liquid is substantially disengaged from each yarn in at least one of the chambers.

Excess liquid finish is drained to an external receptor.

The yarns are passed out of the last chamber of the applicator device through exit openings.

As used herein throughout, pressure means the highest pressure at the finish-yarn interface along the yarn path through the device. This highest pressure is expected to be localized in the vicinity of the restricted yarn passages (see below).

Preferably, the liquid finish contacts the yarn at a pressure at least about 10 psi (68.9 kPa). More preferably, the liquid finish contacts the yarn at a pressure at least about 20 psi (138 kPa). Most preferably, the liquid finish contacts the yarn at a pressure at least about 40 psi (276 kPa).

Preferably, the liquid finish is supplied continuously using a pump. Increasing the finish feed rate to the applicator device yields an increase in finish on the yarn at a given yarn speed. The finish feed rate required to apply a given level of finish at a particular yarn speed and for particular applicator dimensions is readily found by calibration of the device.

The finish applied to the yarn in traversing the applicator device is preferably about 0.2 wt. % to about 5 wt. % with a coefficient of variation (COV) less than about 10%. More preferably, the finish applied is about 0.4 to about 4 wt. % with a COV less than about 10%. Most preferably, the finish applied is about 0.5 wt. % to about 2 wt. % with a COV less than about 10%.

The invention includes the apparatus by which the above method may be practiced. In this embodiment termed an "immersion applicator" illustrated in part by a sectional sketch in FIG. 1, the invention is an applicator device for applying finish liquid to one or more high speed running yarns. The applicator device has a top portion (50) and a mated bottom portion (60) sealed to the top portion at its exterior surfaces. This seal may be provided by machining the top and bottom portions to close tolerances. However, separate sealing means such as seals or gaskets are preferred to be placed between the top and bottom portions to prevent external leakage at their mated surfaces.

The bottom portion has yarn entry openings in its front surface for each individual yarn (5) and exit openings (7) in its rear surface for each individual yarn. The yarn entry openings are constricted to substantially block air boundary layers entrained by each yarn.

The bottom portion has one or more interior walls dividing the bottom portion into two or more consecutive chambers (40). Each of the interior walls in the bottom portion has constricted yarn passages (6), individual for each yarn, connecting the preceding and succeeding chambers. The constricted yarn passages also serve as yarn guides and may be inserts made of materials such as ceramics different than the surrounding wall materials. Such passages are open at their intersections with the top surface of the bottom portion for ease of yarn string-up. In operation of the finish applicator device, the tops of the passages are closed by the bottom surface of the top portion.

At least one of the chambers in the bottom portion is in communication with external source of finish liquid through a finish liquid supply duct (11) to permit feeding liquid from below the yarn path. At least one of the chambers in the bottom portion is in communication with an external drain (20).

The top portion has one or more interior walls dividing the top portion into consecutive chambers (70) corresponding in number and location to mating chambers in the bottom portion. At least one of the chambers in the top portion is in communication with an external source of finish liquid (10).

The dimensions of the chambers in the top and bottom portions are chosen by compromise between desire for compactness and flexibility of operation. Greater chamber length in the direction of yarn travel accommodates higher levels of finish application or higher yarn speeds, but less compactness. It is preferred that the length of the chambers in the direction of yarn travel is between about 1 cm to about 10 cm, and more preferably is between about 1.25 cm and 7 cm. The width of the chambers is preferred to be between about 0.2 cm and 2 cm. The depth of the chambers is preferred to be between about 1 cm and about 7 cm.

It is preferred that finish liquid is fed to two or more sequential chambers and that excess finish liquid is disengaged from the yarn in two or more subsequent chambers.

There are also means (not shown) to hold the bottom surface of the top portion and said top surface of the bottom portion together in mated and sealed position.

Preferably, the top portion and the bottom portion are connected at one of their side surfaces by hinge means. Preferably, the top portion and the bottom portion are connected at the other of their side surfaces by quick opening clamps means. The finish applicator device is quickly and easily opened for yarn string-up along the bottom portion and quickly and easily closed and placed in service.

A two yarn-end applicator of this design has been fabricated.

Without being held to a particular theory of why the invention works, it is believed that the constriction of the yarn entry openings (5) and the constricted yarn passages between chambers (6) are essential features of the device. The constrictions of the yarn entry openings substantially block the air boundary layers surrounding the yarns from entry into the device. This minimizes interference of the air with contact between the yarn and the finish in the chambers. The high speed running yarn in contact with the liquid finish in a chamber entrains a liquid boundary layer. Stagnation of the high speed liquid boundary layer at the face of a constricted yarn passage converts kinetic energy into pressure head. Finite element modeling indicates such constriction of the yarn passages between the chambers gives rise to high localized contact pressures between the liquid finish and the yarn at the entrance of, and within the yarn passages. The contact pressures so generated are expected to be much higher than, and add to, the liquid finish pressure at the inlets to the device (10, 11).

The cross-sections of the yarn passages into and through the device (5, 6, 7) may be circular, oval, rectangular or some more complex shape. Preferably, the yarn entry openings (5) have constant dimensions in the direction of yarn travel. The yarn passages within the device (6) may be straight, tapered or pulsatile. Preferably, the yarn entry openings (5), and the yarn passages (6) are so constricted as to have no dimension greater than about ten times the effective yarn diameter. More preferably, the yarn entry openings (5), and the yarn passages (6) are so constricted as to have no dimension greater than about six times the effective yarn diameter. The effective yarn diameter is obtained from the following relationship:

$$ED = 1.33\sqrt{\frac{4d}{9\times 10^5 \pi\rho}}$$

where:

ED is the effective yarn diameter, cm d is the yarn denier

ρ is the density of the polymer constituting the yarn filaments (1.39 g/cm$^3$ for polyethylene terephthalate)

Preferably also, the dimensions of the yarn entry openings (5) are so constricted as to block at least about 75% of the cross-sectional area of the air boundary layer entrained with each yarn. For the purposes of this invention, the cross-sectional area of the air boundary layer is as calculated by Equations (26) to (31) of B. C. Sakiadis, *A.I.Ch.E. Journal,* 7(3) 467–472 (1961). The thickness of the air boundary layer calculated in this manner is believed to be a minimum bound (most conservative estimate) of the actual air boundary layer dimensions.

The dimensions of the air boundary layer depend on the denier of the yarn, the yarn speed and the distance along the yarn from the last solid surface traversed. Table I shows the air boundary layer thickness calculated by the above referenced Sakiadis relationships for poly(ethylene terephthalate) yarns of 50 to 3000 denier, yarn speeds of 3000 to 10,000 m/min, and distances from the last solid surface of 0.2 and 0.813 m. Also shown in Table I is the percentage of the air boundary layer cross-sectional area that is blocked by an applicator yarn entry opening having a cross-sectional area of 0.0335 cm$^2$ and no dimension greater than the boundary layer thickness.

TABLE I

| Yarn denier | Yarn velocity, m/min | Distance along yarn, M | δ boundary layer thickness, cm | % of boundary layer blocked |
|---|---|---|---|---|
| 50 | 3000 | 0.2 | 0.233 | 81 |
| 50 | 3000 | 0.813 | 0.446 | 95 |
| 50 | 5400 | 0.2 | 0.218 | 78 |
| 50 | 5400 | 0.813 | 0.417 | 94 |
| 50 | 10000 | 0.2 | 0.203 | 75 |
| 50 | 10000 | 0.813 | 0.388 | 93 |
| 100 | 3000 | 0.2 | 0.269 | 86 |
| 100 | 3000 | 0.813 | 0.517 | 96 |
| 100 | 5400 | 0.2 | 0.251 | 84 |
| 100 | 5400 | 0.813 | 0.483 | 96 |
| 100 | 10000 | 0.2 | 0.234 | 81 |
| 100 | 10000 | 0.813 | 0.450 | 95 |
| 300 | 3000 | 0.2 | 0.336 | 91 |
| 300 | 3000 | 0.813 | 0.652 | 98 |
| 300 | 5400 | 0.2 | 0.313 | 90 |
| 300 | 5400 | 0.813 | 0.609 | 97 |

TABLE I-continued

| Yarn denier | Yarn velocity, m/min | Distance along yarn, M | δ boundary layer thickness, cm | % of boundary layer blocked |
|---|---|---|---|---|
| 300 | 10000 | 0.2 | 0.291 | 88 |
| 300 | 10000 | 0.813 | 0.567 | 97 |
| 1000 | 3000 | 0.2 | 0.426 | 95 |
| 1000 | 3000 | 0.813 | 0.837 | 99 |
| 1000 | 5400 | 0.2 | 0.396 | 94 |
| 1000 | 5400 | 0.813 | 0.781 | 98 |
| 1000 | 10000 | 0.2 | 0.366 | 93 |
| 1000 | 10000 | 0.813 | 0.726 | 98 |
| 3000 | 3000 | 0.2 | 0.522 | 97 |
| 3000 | 3000 | 0.813 | 1.045 | 99 |
| 3000 | 5400 | 0.2 | 0.484 | 96 |
| 3000 | 5400 | 0.813 | 0.974 | 99 |
| 3000 | 10000 | 0.2 | 0.447 | 95 |
| 3000 | 10000 | 0.813 | 0.904 | 99 |

It will be seen from Table I that at least 75% of the cross-sectional area of the air boundary layer in motion with the yarn is blocked for all of the above combinations of yarn denier, speed and distance when the applicator yarn entry opening has a cross-sectional area of 0.0335 cm$^2$. Preferably, the cross-sectional area of each yarn entry opening and each yarn passage is no greater than about 0.0335 cm$^2$.

In another embodiment, the invention is a method for applying a liquid finish to one or more high speed running yarns comprising the steps of:

passing one or more running yarns into a finish applicator device; substantially blocking and disengaging the air boundary layer in motion with each yarn and venting it to the exterior of said finish applicator device; contacting the yarns with a liquid finish under pressure; substantially disengaging the excess finish from the yarns; and passing the yarns out of the applicator device.

In one realization of this embodiment, the invention is a method for applying a finish liquid to one or more high speed running yarns utilizing an essentially box-like device having yarn entry openings and ducts behind the yarn entry openings to divert and discharge the air boundary layers at the lateral surfaces of the device. Within the device, one or more pressurized jets of finish liquid impinge on the yarns traveling in a channel. Excess finish liquid is captured and drained from one or more internal downstream chambers.

More specifically, in this realization, the invention is a method for applying a liquid finish to high speed running yarns as follows:

One or more running yarns are passed into an applicator device.

Each yarn is passed through a constricted passage within the applicator device that substantially blocks the air boundary layer entrained with the yarn.

The air boundary layer entrained by each yarn is vented to the exterior of the applicator device.

One or more jets of finish liquid supplied under pressure from an external source are impinged onto each yarn within the applicator device.

Each yarn passes into one or more sequential chambers in which excess liquid finish is substantially disengaged from the yarn.

Excess finish liquid is drained from the chambers to an external receptor.

The yarns are passed out of the last chamber of the applicator device.

Preferably, the liquid finish contacts the yarn at a pressure at least about 10 psi (68.9 kPa). More preferably, the liquid finish contacts the yarn at a pressure at least about 20 psi (138 kPa). Most preferably, the liquid finish contacts the yarn at a pressure at least about 40 psi (276 kPa).

The finish applied to the yarn in traversing the applicator device is preferably about 0.2 wt. % to about 5 wt. % with a coefficient of variation (COV) less than about 10%. More preferably, the finish applied is about 0.4 to about 4 wt. % with a COV less than about 10%. Most preferably, the finish applied is about 0.5 wt. % to about 2 wt. % with a COV less than about 10%.

Venting of the air boundary layer to the exterior of the device may optionally be aided by applying suction from an exterior vacuum producing means such as a vacuum pump or aspirator.

Figure 2:
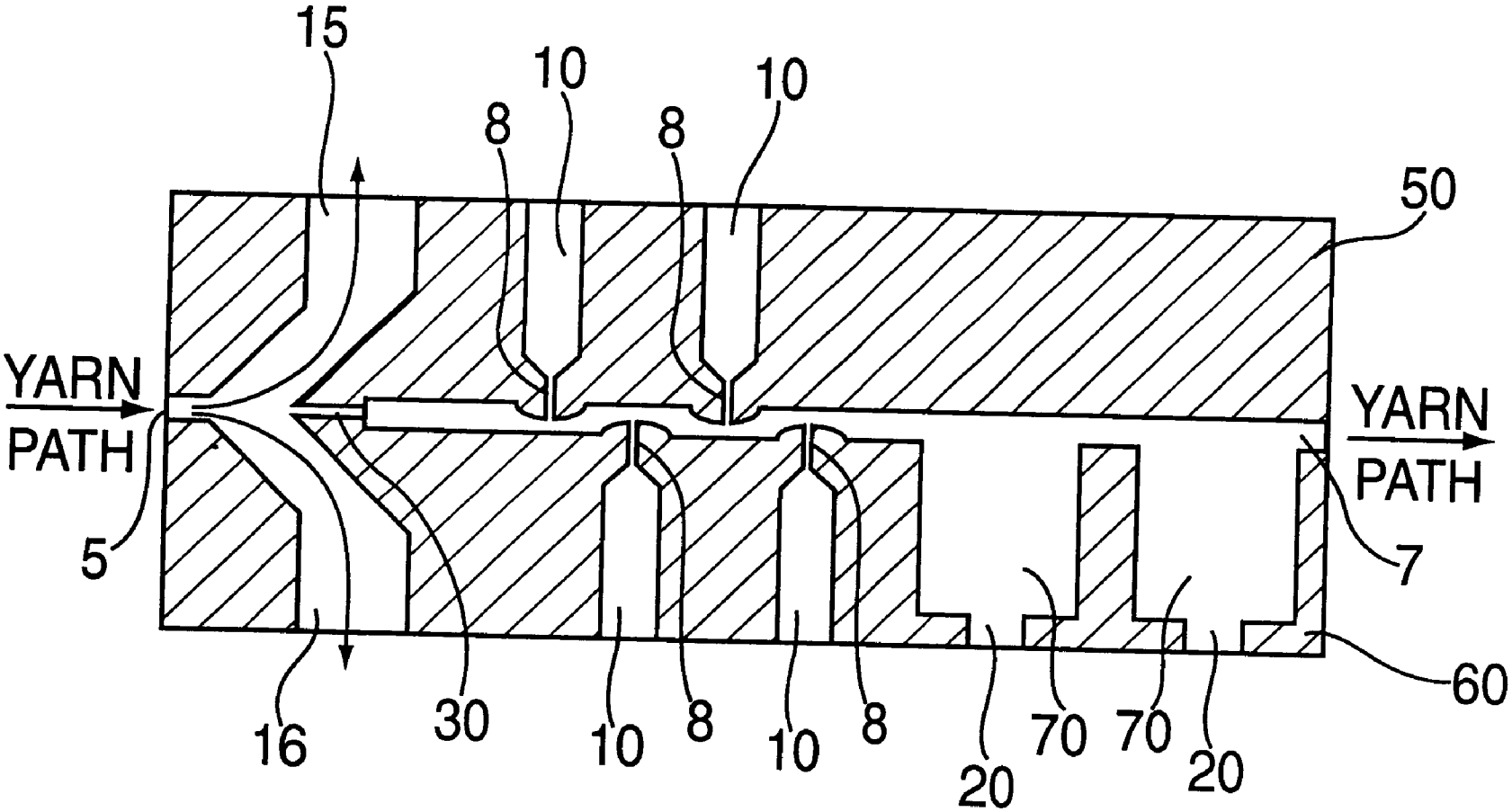
FIG. 2 shows a sectional sketch of a second finish applicator of the invention termed a "slotted applicator".

The invention includes the apparatus by which the above method may be practiced illustrated in part by a sectional sketch in FIG. 2. The invention is an applicator device termed a "slotted applicator" for applying finish liquid to one or more high speed running yarns. The applicator device has a top portion (50) and a mated bottom portion (60) sealed to the top portion. This seal may be provided by machining the top and bottom portions to close tolerances. However, it is preferred that separate sealing means such as seals or gaskets be provided between the top and bottom portions to prevent external leakage at their mated surfaces.

The top portion has grooved channels in its bottom surface, individual for each yarn, extending from the front surface of the top portion to a position intermediate of the distance to the rear surface of the top portion. The bottom portion has grooved channels in its top surface, individual for each yarn, extending from the front surface of the bottom portion to a position intermediate of the distance to the rear surface of the bottom portion. The grooved channels in the top surface of the bottom portion are aligned with the grooved channels in the mating bottom surface of the top portion. Yarn entry openings (5) are formed by the intersection of the aligned grooved channels in the top and bottom portions with their respective front surfaces.

The width of the grooved channels in the top and bottom portions is not critical. For compactness, the width of the channels is preferably between about 3 times and 20 times the effective diameter of the yarn to be treated. The depth of the channels is preferably between 1.5 times and 10 times the effective diameter of the yarn to be treated.

Air boundary layer diversion ducts (15) in the top portion communicate between each of the grooved channels and the top surface of the top portion. Air boundary layer diversion ducts (16) in the bottom portion communicate between each of the grooved channels and the bottom surface of the top portion. Each of the air boundary layer diversion ducts in the top portion and in the bottom portion intersect its corresponding grooved channel in the vicinity of the respective front surfaces of the top and bottom portions forming an acute angle of about 10° to about 50° with the corresponding grooved channel, said acute angles opening outward rearward.

A first restriction (30) in the dimensions of each grooved channel is placed rearward of, and in the proximity of the intersection of the air boundary layer diversion duct with the grooved channel. The dimensions of the first restriction are critical (see below).

One or more liquid supply ducts (10) communicates between each of the grooved channels and an external pressurized source of finish liquid. The liquid supply ducts are placed rearward of the first restriction in the dimensions of each grooved channel. The terminus of each liquid supply duct at its intersection with its corresponding grooved channel is constricted so as to form a jet nozzle. The terminus of each liquid supply duct at its intersection with its corresponding grooved channel also forms a second and subsequent restriction (8) in its corresponding channel.

The bottom portion has rearward of the most rearward liquid supply duct, one or more internal walls defining two or more chambers (70). The chambers communicate with an external drain (20).

The dimensions of the chambers are not critical. For compactness, it is preferred that the length of the chambers in the direction of yarn travel is between about 1 cm to about 10 cm, and more preferably is between about 1.25 cm and 7 cm. The width of the chambers is preferred to be between about 0.2 cm and 2 cm. The depth of the chambers is preferred to be between about 1 cm and about 7 cm. It is preferred that the excess finish is disengaged from the yarn in two or more sequential chambers.

An exit opening (7) for each yarn is present in the rear surface of the bottom portion.

Means (not shown) are provided to hold the top portion and the bottom portion together in sealed and mated position. Preferably, the top portion and the bottom portion are connected at one of their side surfaces by hinge means and are connected at the other of their side surfaces by quick opening clamps means.

The first restrictions (30) in the grooved channels are so dimensioned as to block at least about 75% of the cross-sectional area of the air boundary layer entrained with each yarn. Preferably, the cross-sectional area of the first restriction is less than about 0.0335 $cm^2$. Preferably, the cross-sectional area of the second and subsequent restrictions (8) in the grooved channels are no more than about five times the cross-sectional area of the first restriction.

The first (30) and subsequent restrictions (8) in the grooved channels as well as the air boundary layer diversion ducts (15 and 16) are believed to be essential features of the device. The first restriction substantially blocks the air boundary layers in motion with the yarns. The air boundary layer diversion ducts vent the entrained air to the exterior of the device before the yarn contacts the finish. Finite element modeling indicates that the subsequent restrictions of the grooved channels give rise to high contact pressures between the liquid finish and the yarn at the entrance of, and within the restricted channels. Such pressures are expected to be much higher than, and add to, the liquid finish pressure at the inlets to the device (10).

A one yarn-end applicator of this design has been fabricated.

Figure 3:
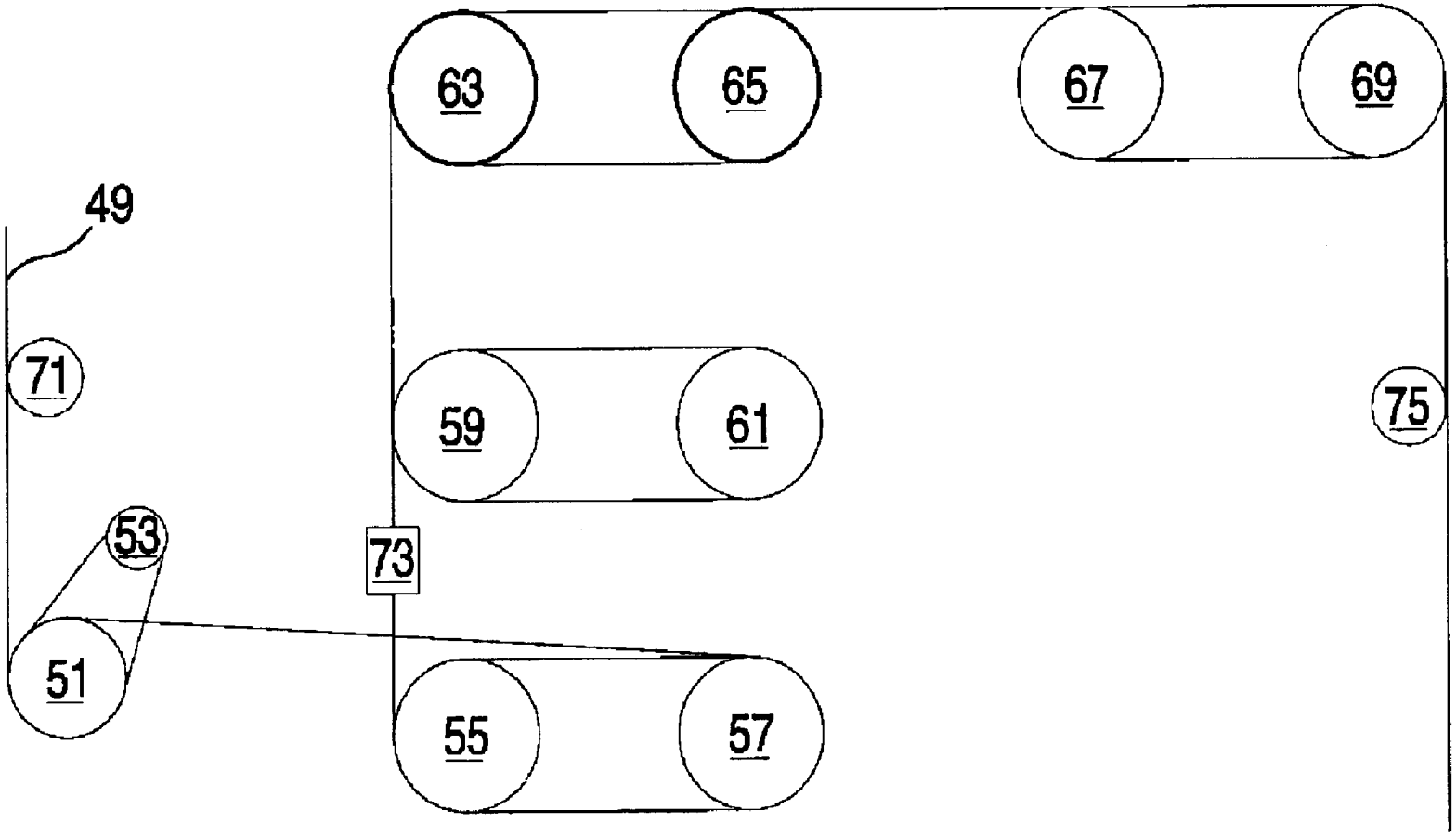
FIG. 3 PRIOR ART
FIG. 3 shows a prior art draw panel with an prior art finish applicator located after the draw rolls and before a winder.

The finish applicator devices of the invention are advantageously used directly on a draw panel in-line with spinning. A representative prior art four-zone draw panel is shown in FIG. 3. After spinning (not shown), a yarn end (49) contacts a first finish kiss roll (71) which applies a first finish on the yarn intended to help processability and drawability. The yarn end is then fed in sequence to a first drawing zone between driven roll (51) and idler roll (53) and driven roll pair (55 & 57); to a draw assist device (73) such as a steam jet; to a second draw zone between roll pairs (55 & 57) and (59 & 61); and to third and fourth drawing zones using heated roll pairs (63 & 65) and (67 & 69), respectively. The yarn end (49) then contacts an overfinish applicator device (75) which may be similar to that described in U.S. Pat. No. 4,268,550 and the yarn is fed to a winder (not shown).

There are several difficulties with the prior art draw panel that are resolved by the present invention. First, the prior art overfinish applicators are unable to achieve necessary finish concentrations and uniformity at yarn speeds of about 3000 m/min and above. This limits process productivity. Second, the prior art finish applicators produce a spray of finish in the vicinity of the device, thus creating safety and environmental problems. Third, the spray problem is more severe when the overfinish is applied to a yarn running in a horizontal plane rather than in a vertical plane. This limits the ability to apply overfinish between the heated draw rolls in a conventional draw panel, and therefore to dry and cure the finish before the yarn reaches the winder. With the prior art finish applicator in the arrangement shown, the finish on the yarn may still be wet as the yarn reaches the winder. These difficulties reinforce one another creating an overall problem greater than the sum of its parts.

Figure 4:
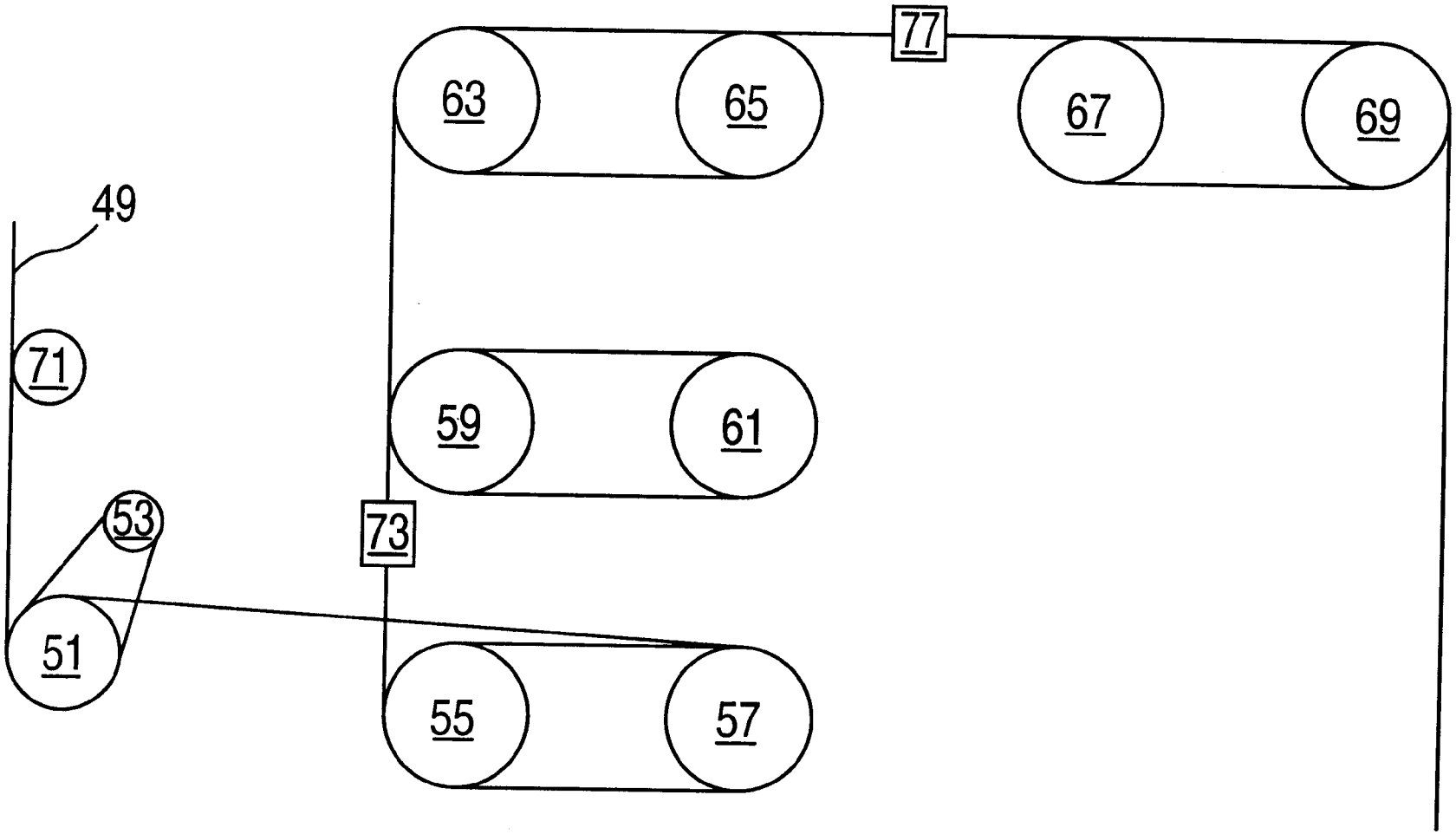
FIG. 4 shows a draw panel with an inventive overfinish applicator located before the final pair of draw rolls.

In contrast, a finish device of the invention may be located on a draw panel where the yarn runs in a horizontal plane between heated draw rolls as illustrated in FIG. 4. The draw panel may be either a four-zone or five-zone panel. In either configuration, the inventive finish device is preferably located in the final draw zone. Shown in FIG. 4 is the same four-zone draw panel as that in FIG. 3. The part numbers correspond in FIGS. 3 and 4. However, in FIG. 4, the prior art overfinish applicator has been removed and an inventive finish device is located between heated roll pairs (63 & 65) and (67 & 69). The inventive finish applicator provides the ability to overfinish the yarn to desired finish concentrations and uniformity, and with little or no spray. Equally significant, the finish on the yarn may now be dried and cured to enhance yarn properties on-line.

The invention includes a yarn finishing method comprising the steps of: applying a liquid finish to one or more yarns running at speeds greater than about 3000 m/min at a position between heated rolls on a draw panel; drying said finish during passage over said rolls; and collecting a dry drawn yarn on a winder.

Figure 5:
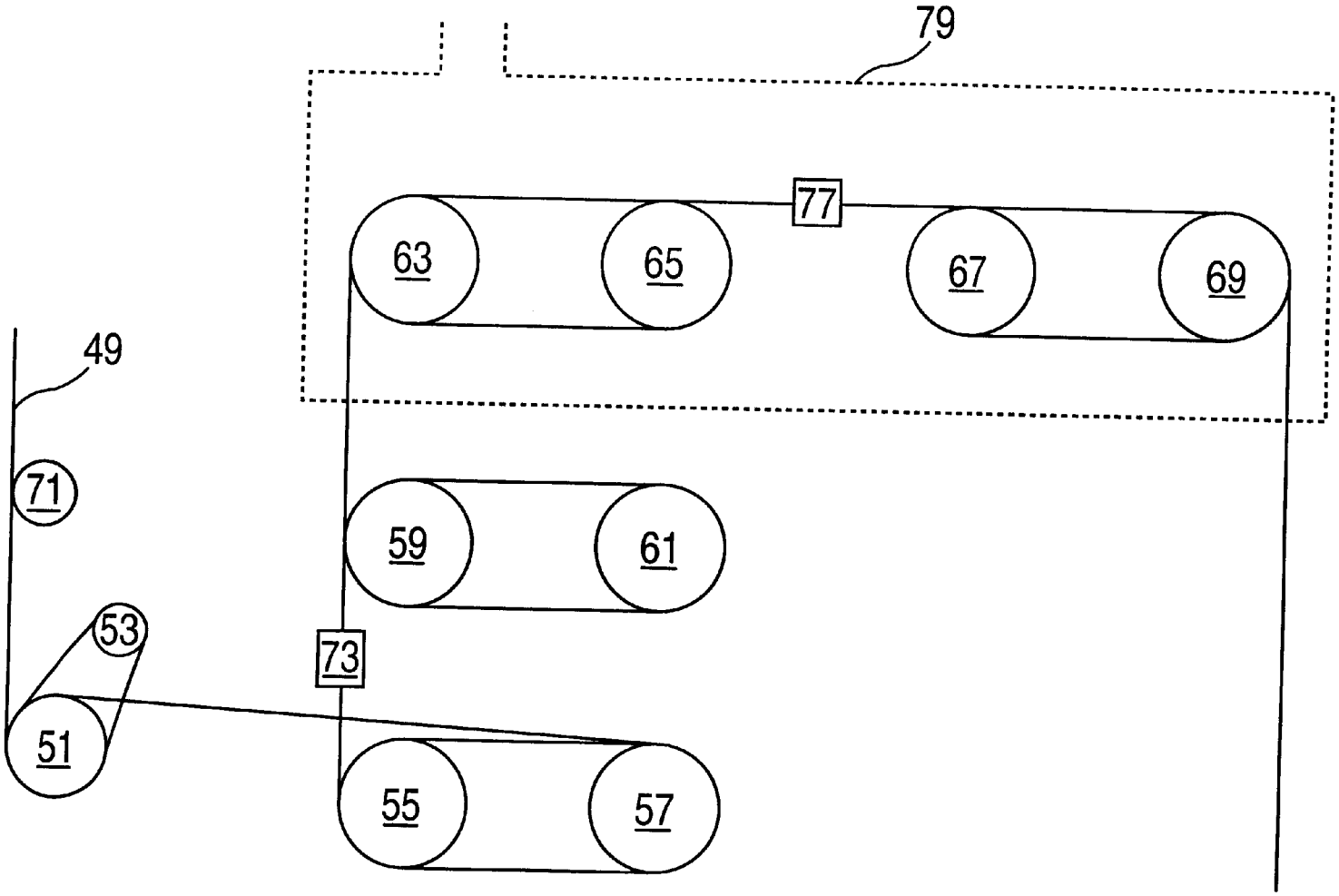
FIG. 5 shows the same draw panel as FIG. 4 with the inventive overfinish applicator and the adjacent draw rolls enclosed in a vented box.

It should be noted that as some overfinishes may contain substances that are hazardous when volatilized on the heated draw rolls, it may be necessary to evacuate the volatiles from the working area. This may be done by installing an exhaust hood above the last draw zone, or optionally, placing an vented enclosure (79) around the last draw zone as shown in FIG. 5.

The invention also includes an overfinished yarn product prepared by the process comprising the steps of:

a) actively applying an overfinish to a yarn at a position between heated rolls, at a yarn speed greater than about 3000 m/min at a concentration of about 0.2 wt. % to about 5 wt. %, with a coefficent of variation of concentration of 10% or less;

b) drying said overfinish during passage over said heated rolls.

Yarns suitable for use in the invention include any yarn to which finish is applied including yarn made of polyamides, polyesters, polyolefins, poly(aramides) and polybenzazoles. Specific polyamides include nylon-6 and nylon-6,6. Specific polyesters include poly(ethylene terephthalate), poly (trimethylene terephthalate) and poly(ethylene naphthalate). Specific polyolefins are polyethylene and polypropylene. Specific polyaramides include ortho-, meta- and para- poly (phenylene terepthalamide). Specific polybenzazoles include poly(benoxazole) and poly(benzthiazole).

Filaments may have round or other cross-sectional shapes.

Finish on the yarn (FOY) is routinely determined using NMR (nuclear magnetic resonance) previously calibrated against known standards. As used herein, FOY is the "total finish" and refers to the sum of a first finish and any overfinish on the yarn.

NMR offers rapid analysis but it is not a primary method. Primary standards are prepared for each spin finish and overfinish system that is used. FOY values for these standards are determined by extracting the finish with a known good solvent for the finish (e.g cyclohexane, methanol) and determining the weight of the extract after evaporation of the solvent. The NMR measurements are correlated with the extraction data.

The method of determining FOY using NMR is as follows: a yarn sample (about 2 grams) is weighed, placed in a glass tube and inserted into the NMR cavity. A strong magnetic field causes the protons (hydrogen atoms) in the oil portion of the finish to line up. A radio frequency pulse is then applied at the resonance frequency to produce a signal called a free induction decay. The magnitude of this signal is proportional to the number of protons in the finish and hence its concentration. The calibration standards are retained and used to check the stability of the calibration daily.

Unknown samples are measured in the same way as the standards. A sample of about 2 grams is placed in the glass tube and the NMR signal is measured. Since the relationship between NMR signal and FOY is thus known, FOY is calculated by the software and displayed by the instrument. An overfinish may also be analyzed by x-ray fluorescence (XRF) when the overfinish contains silicon. Such overfinishes are described for example, by U.S. Pat. Nos. 4,617,236 and 4,397,985, hereby incorporated by reference herein to the extent not incompatible herewith. Again the XRF method is not a primary method and must be calibrated against standard samples analyzed by extraction. However, the XRF method, because of its sensitivity to the silicon component, can determine the concentration of overfinish separately from the concentration of a lubricating spin finish.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES

Comparative Example 1

A 250 filament polyethylene terephthalate (PET) yarn was drawn on a draw panel as shown in FIG. 3. A spin finish was applied to the yarn using a rotating ceramic kiss roll of 5.5 inch (14 cm) diameter partially immersed in a pan of spin finish. The spin finish kiss roll was located at the entrance to the draw panel at the position labeled (71) in FIG. 3. The finish roller speed was 13 RPM.

A package of yarn was collected under these conditions and then rewound with a yarn sample taken for determination of FOY approximately every 500 meters. The average of seventeen determinations of FOY was 0.354 wt. %

A PET yarn of 200 filaments was drawn in the same manner as described above. Fourteen FOY determinations approximately every 500 meters along the yarn averaged 0.386 wt. %.

Comparative Example 2 and Examples 1 and 2

An experiment was performed to compare overfinish application on a draw panel at a yarn speed of about 5400 m/min by the following means:

a) In Comparative Example 2, a prior art applicator similar to that described in U.S. Pat. No. 4,268,550.

b) In Example 1, an "immersion applicator" of the invention (FIG. 1) having a single liquid fed chamber having a length of 3.95 inches (10.03 cm) in the direction of yarn travel;

c) In Example 2, a "slotted applicator" of the invention (FIG. 2)

The yarn in each case was a 300-filament PET. Approximately 0.386 wt. % spin finish was applied by a kiss roll applicator (at position 71 in FIGS. 3 and 4) to each yarn at speed of about 2800 meters per minute at the entrance to the draw panel.

Overfinish was applied to the yarns by each of the devices listed above. The overfinish composition was similar to those described in U.S. Pat. No. 4,617,236 having a room temperature viscosity of 4.8 centistokes and a density of 0.98 g/cm$^3$. The speed of the yarn as it passed the overfinish applicator was about 5400 meters per minute in each case. The yarn denier at each overfinish applicator was about 1000 denier.

Comparative Example 2

The prior art finish applicator was located after the draw panel and before the winder in the position labeled 75 in FIG. 3. A very high degree of finish spray to the surrounding area was generated at the finish applicator. The total finish on yarn (FOY) averaged 0.465 wt. %. The overfinish picked up from the prior art applicator at 5400 m/min was therefore only about 0.465−0.386=0.079 wt. %.

It should be noted that the magnitude of the spraying with prior art applicator prevented its placement in the last draw stage. The finish spray created with this device would build up on the draw rolls and eventually cause yarn defects or breakage. It should also be noted that with placement of the prior art finish applicator after the last draw stage, the yarn going to the winder was wet with uncured overfinish. Pooling of the wet overfinish where yarns were in contact on the wound package produced further non-uniformity in finish coverage.

Example 1 and Example 2

A finish applicator of the invention was place in the location labeled 77 in FIG. 4 between the heated roll sets in the final draw stage. The distance from the roll labeled 65 to the entrance of an inventive finish applicator was 32 inches (0.813 meters).

The cross-sectional area of the yarn entry openings (FIG. 1, yarn entry opening (5)), and the area of the constricted passages (FIG. 1, constricted yarn passage (6)) of the "immersion applicator" were 0.0335 cm$^2$. No dimension of the yarn entry openings was greater than 5.5 times the effective diameter of the yarn. In the "slotted applicator" the cross-sectional area of the first restriction (FIG. 2, first restriction (30)) in the channel was 0.0116 cm$^2$. The cross-sectional areas of the subsequent restrictions in the channel were 0.0503 cm$^2$ or about 4.3 times the cross-sectional area of the first restriction.

The percent of the air boundary layer cross-section that was blocked by each of the inventive finish applicators was at least 98%. Yarn-finish contact pressures in each of the inventive finish applicators estimated from finite element numerical modeling were greater than 40 psi (276 kPa).

Finish was supplied to each of the inventive finish applicators from a reservoir by means of positive displacement gear pump with a variable speed drive. The finish feed rate to the applicators was varied and is shown in Table II. Excess finish was disengaged from the yarn within an applicator, drained, and sent to a reservoir for recycling.

The overfinish and the FOY (spin finish plus overfinish) applied to the yarns is listed in Table II. Little, if any finish spray to the environment was generated at any finish level.

TABLE II

| Overfinish | Overfinish, wt. % | | FOY, % | |
|---|---|---|---|---|
| Feed Rate, ml/min | Example 1 "immersion" applicator | Example 2 "slotted applicator" | Example 1 "immersion" applicator | Example 2 "slotted applicator" |
| 22 | 0.17 | — | 0.56 | — |
| 130 | 1.03 | 0.084 | 1.42 | 0.47 |
| 380 | 2.95 | — | 3.34 | — |
| 670 | 5.20 | 2.93 | 5.59 | 3.32 |

Examples 1 and 2 of the invention demonstrate that at a yarn speed of 5400 m/min, an inventive active finish applicator can provide finish application of about 5.2% and levels of FOY up to about 5.6 wt. %. Comparison of the FOY data for Examples 1 and 2 with Comparative Example 2 demonstrate that at a yarn speed of 5400 m/min, the inventive active finish applicators can provide significantly higher levels of FOY compared to the prior art kiss roll, and without generating spray to the environment. It is expected that finish levels of 6 wt. % or more may be applied by the methods and devices of the invention at speeds greater than 5000 m/min, and possibly greater than 8000 m/min or greater than 9000 m/min.

In contrast to Comparative Example 2 therefore, the inventive finish applicators were readily placed in the last draw stage. The yarn products after passing over the last heated roll set were dry. This is a substantial advantage of the inventive method, and a novel feature of the yarns so produced.

The data also demonstrate that the finish application by the inventive applicators can be controlled by the finish feed rate.

Example 3

A 250 filament, 1000 denier PET yarn was overfinished at 5400 m/min using an "immersion applicator" similar to that described in Example 1 but having two liquid fed chambers whose total length in the direction of yarn travel was 1.5 inches (3.81 cm). The cross-sectional area of the yarn entry openings (FIG. 1, yarn entry opening (5)), and the area of the constricted passages (FIG. 1, constricted passages (6)) of the "immersion applicator" were 0.0335 cm$^2$. No dimension of the yarn entry openings was greater than 5.5 times the effective diameter of the yarn. The percent of the air boundary layer cross-section that was blocked from entry into the finish applicator was at least 98%. Yarn-finish contact pressure estimated from finite element numerical modeling was greater than 40 psi (276 kPa).

Approximately 0.386 wt. % spin finish was applied by a kiss roll applicator at a speed of about 2800 meters per minute at the entrance to the draw panel. The placement of the "immersion applicator" between heated godets was as described in Example 1. The overfinish feed rate to the applicator was about 250 ml/min. The overfinish composition was similar to one described in U.S. Pat. No. 4,617,236 having a room temperature viscosity of 4.8 centistokes and a density of 0.98 g/cm$^3$.

The yarn was dry as it left the last heated godet. A package of yarn was collected and then rewound with a yarn sample taken for determination of FOY approximately every 500 meters. The results of the determinations are shown in Table III below.

TABLE III

| Rewind package number | FOY, wt. % |
|---|---|
| 1 | 1.48 |
| 2 | 1.40 |
| 3 | 1.26 |
| 4 | 1.31 |
| 5 | 1.50 |
| 6 | 1.34 |
| 7 | 1.36 |
| 8 | 1.24 |
| 9 | 1.33 |
| 10 | 1.17 |
| 11 | 1.36 |
| 12 | 1.21 |
| 13 | 1.09 |
| 14 | 1.30 |
| 15 | 1.29 |
| 16 | 1.36 |
| 17 | 1.26 |
| Average | 1.31 |
| COV, % | 7.9 |

The overfinish applied, by difference between the FOY and the spin finish, was about 1.31 wt. %−0.386 wt. %=0.92 wt. %.

The data of Example 3 demonstrate that yarn with about 0.9 wt. % overfinish and more than 1 wt. % FOY and can be prepared with a uniformity (COV) of less than 10% using a finish applicator and method of the invention.

Example 4

A 250 filament, 1000 denier PET yarn is overfinished at 3000 m/min using an "immersion applicator" and overfinish as described in Example 3. The percent of the air boundary layer cross-section that is blocked from entry into the finish applicator is at least 99%. Yarn-finish contact pressure estimated from finite element numerical modeling is greater than 10 psi (68.9 kPa).

Approximately 0.4 wt. % spin finish is applied by a kiss roll applicator at a speed of about 1550 meters per minute at the entrance to the draw panel. The placement of the "immersion applicator" between heated godets and the procedure are as described in Example 3. The finish feed rate to the applicator is about 250 ml/min.

Overfinish applied to the yarn is about 0.7 wt. % with a COV of about 8%. FOY is about 1.1 wt. %. The yarn is dry as it leaves the last heated godet.

Example 5

A 250 filament, 1000 denier PET yarn was overfinished at 5400 m/min using an "immersion applicator" and overfinish as described in Example 3. The placement of the "immersion applicator" between heated godets and the procedure were as described in Example 3. The percent of the air boundary layer cross-section that was blocked from entry into the finish applicator was at least 98%. Yarn-finish contact pressure estimated from finite element numerical modeling was greater than 40 psi (276 kPa).

Approximately 0.40 wt. % spin finish was applied by a kiss roll applicator at a speed of about 2800 meters per minute at the entrance to the draw panel. The finish feed rate to the applicator was about 165 ml/min. The overfinish composition was the same as in Example 3.

The yarn was dry as it left the last heated godet. A package of yarn was collected and then rewound with two yarn samples (labeled "A" and "B") taken at the same point for duplicate determinations of FOY approximately every 500 meters. The results of the determinations are shown in Table IV below.

TABLE IV

| | FOY, % | |
|---|---|---|
| Rewind package number | "A" Sample | "B" Sample |
| 1 | — | 0.87 |
| 2 | — | 0.90 |
| 3 | 0.93 | 0.85 |
| 4 | 1.07 | 1.03 |
| 5 | 1.12 | 1.02 |
| 6 | 0.96 | 0.94 |
| 7 | 1.07 | 1.00 |
| 8 | 0.97 | 1.01 |
| 9 | 0.97 | 0.98 |
| 10 | 0.89 | 0.94 |
| 11 | 0.97 | 0.93 |
| 12 | 0.95 | 0.98 |
| 13 | 1.07 | 0.94 |
| 14 | 0.99 | 0.96 |
| 15 | 0.91 | 0.94 |
| 16 | 1.01 | 1.06 |
| 17 | 0.82 | 0.98 |
| Average | 0.98 | 0.96 |
| COV | 8.1% | 5.0% |

An analysis of variance of the data of Table IV shows the standard error of measurement of FOY between any two samples at the same position was 0.079% FOY. The variation of FOY along a yarn overfinished by a device of the invention was about the same as the error in measurement.

The overfinish applied, by difference between the FOY and the spin finish, was about 0.97 wt. %−0.40 wt. %=0.57 wt. %.

Example 6

A 300 filament, 1000 denier PET yarn was overfinished at 5300 m/min using an "immersion applicator" and overfinish as described in Example 3. The placement of the "immersion applicator" between heated godets and the procedure were as described in Example 3. The percent of the air boundary layer cross-section that was blocked from entry into the overfinish applicator was at least 98%. Yarn-finish contact pressure estimated from finite element numerical modeling was greater than 40 psi (276 kPa).

Approximately 0.38 wt. % spin finish was applied by a kiss roll applicator at a speed of about 2700 meters per minute at the entrance to the draw panel.

The overfinish feed rate to the "immersion applicator" was varied with the resulting finish application shown in Table V. The yarn was dry as it left the last heated godet.

TABLE V

| Overfinish Feed Rate, ml/min | Overfinish, wt % | FOY, wt. % |
|---|---|---|
| 0 | 0 | 0.38 |
| 84 | 0.27 | 0.65 |
| 96 | 0.38 | 0.77 |
| 96 | 0.28 | 0.67 |
| 96 | 0.40 | 0.79 |
| 108 | 0.31 | 0.69 |

TABLE V-continued

| Overfinish Feed Rate, ml/min | Overfinish, wt % | FOY, wt. % |
|---|---|---|
| 120 | 0.32 | 0.71 |
| 120 | 0.40 | 0.79 |
| 120 | 0.43 | 0.81 |
| 132 | 0.48 | 0.87 |
| 144 | 0.65 | 1.04 |
| 144 | 0.52 | 0.91 |
| 144 | 0.52 | 0.91 |

The data of Example 6 illustrate the response of the overfinish application rate to the overfinish feed rate in the range of about 0.2 wt. % to about 0.7 wt. % overfinish.

Example 7

Approximately 0.39 wt. % spin finish is applied to a 250 filament, 1920 denier PET at about 4000 m/min. The yarn is overfinished between heated godets at about 8,100 m/min using an "immersion applicator " as described in Example 3. The percent of the air boundary layer cross-section that is blocked from entry into the finish applicator is at least 98%. Yarn-finish contact pressure estimated from finite element numerical modeling is greater than 60 psi (414 kPa). The placement of the overfinish applicator and the procedure are as described in Example 3. The finish feed rate to the applicator is about 370 ml/min.

Overfinish applied to the yarn is about 0.51 wt. % with a COV of about 9%. FOY is about 0.9 wt. %. The yarn is dry as it leaves the last heated godet.

Example 8

Approximately 0.4 wt. % spin finish is applied to a 250 filament, 1920 denier PET yarn at 5200 m/min using the "immersion applicator" and overfinish as described in Example 3. The yarn enters the applicator at a distance of 1.5 meters from the last driven roll. The percent of the air boundary layer cross-section that is blocked from entry into the finish applicator is at least 98%. Yarn-finish contact pressure estimated from finite element numerical modeling is greater than 40 psi (276 kPa). Spin finish feed to the applicator is about 100 ml/min.

The yarn is overfinished between heated godets at 10,000 m/min using an "immersion applicator" as described in Example 3. The percent of the air boundary layer cross-section that is blocked from entry into the finish applicator is at least 98%. Yarn-finish contact pressure estimated from finite element numerical modeling is greater than 75 psi (517 kPa). The placement of the overfinish applicator and the procedure are as described in Example 3. The finish feed rate to the applicator is about 500 ml/min.

Overfinish applied to the yarn is about 0.5 wt. % with a COV of about 9%. FOY is about 0.9 wt. %. The yarn is dry as it leaves the last heated godet.

What is claimed is:

1. A method for applying a liquid finish to one or more yarns running at speeds greater than about 3000 m/min and having entrained air boundary layers in motion with each of said yarns comprising the steps of:

a) passing the yarns into a first portion of a split-body finish applicator device in essentially a horizontal plane while substantially blocking the entry of the air boundary layers in motion with the yarns into said finish applicator device;

b) attaching a second portion of said split-body finish applicator device in mated and sealed contact with said first portion of said split-body applicator device;

c) contacting the yarns with a liquid finish under pressure;

d) substantially disengaging excess finish from the yarns; and e) passing the yarns out of the applicator device with 0.2 wt. % to 5 wt % finish applied to each yarn with a coefficient of variation of 10% or less, and with little or no spray.

2. The method of claim 1 wherein at least 75% of the cross-sectional area of the air boundary layer entrained with each yarn is blocked from entry into the applicator device.

3. The method of claim 1 wherein the yarn speed is greater than about 5000 m/min.

4. The method of claim 1 wherein the yarn speed is greater than about 8000 m/min.

5. The method of claim 1 wherein the liquid finish contacts the yarn under a pressure of at least about 10 psi (68.9 kPa).

6. The method of claim 1 wherein the liquid finish contacts the yarn under a pressure of at least about 20 psi (138 kPa).

7. The method of claim 1 wherein the liquid finish contacts the yarn under a pressure of at least about 40 psi (276 kPa).

8. The method of claim 1 wherein the liquid finish applied to the yarn is 0.4 wt. % to 4 wt. % with a coefficient of variation of 10% or less.

9. The method of claim 1 wherein the liquid finish applied to the yarn is 0.5 wt. % to 2 wt. % with a coefficient of variation of about 10% or less.

10. A method for applying a liquid finish to yarns running at speeds greater than about 3000 m/min and having entrained air boundary layers in motion with each of said yarns comprising the steps of:

a) passing one or more running yarns into a first portion of a split-body applicator device in essentially a horizontal plane through a constricted yarn entry opening, individual to each yarn, in an exterior wall member and thence into a first chamber, said constricted opening substantially blocking an air boundary layer entrained by each yarn;

b) attaching a second portion of said split-body finish applicator device in mated and sealed contact with said first portion of said split-body applicator device;

c) passing each said running yarn from said first chamber into at least one additional chamber through at least one sequential constricted opening individual to each yarn in at least one interior wall member;

d) positively feeding a liquid finish from an external source to at least one of said chambers traversed by each yarn;

e) contacting each yarn with said liquid finish under pressure;

f) substantially disengaging excess liquid finish from each yarn in at least one other of said chambers;

g) draining said excess liquid finish to an external receptor; and h) passing each yarn out of the last chamber of the applicator device through a exit opening individual to each yarn in an exterior wall member with 0.2 wt. % to 5 wt % finish applied to each yarn with a coefficient of variation of 10% or less, and with little or no spray.

11. The method of claim 10 wherein at least 75% of the cross-sectional area of the air boundary layer entrained with each yarn is blocked by the constricted yarn entry opening.

12. The method of claim 10 wherein the yarn speed is greater than about 5000 m/min.

13. The method of claim 10 wherein the yarn speed is greater than 8000 m/min.

14. The method of claim 10 wherein the liquid finish contacts the yarn under a pressure of at least about 10 psi (68.9 kPa).

15. The method of claim 10 wherein the liquid finish contacts the yarn under a pressure of at least about 20 psi (138 kPa).

16. The method of claim 10 wherein the liquid finish contacts the yarn under a pressure of at least about 40 psi (276 kPa).

17. The method of claim 10 wherein the liquid finish applied to the yarn is 0.4 wt. % to 4 wt. % with a coefficient of variation of 10% or less.

18. The method of claim 10 wherein the liquid finish applied to the yarn is 0.5 wt. % to 2 wt. % with a coefficient of variation of 10% or less.

19. The method of claim 10 wherein the liquid finish enters through the bottom of said chambers.

20. A method for applying a liquid finish to one or more yarns running at speeds greater than about 3000 m/min and having entrained air boundary layers in motion with each of said yarns comprising the steps of:

a) passing a plurality of running yarns into a first portion of a split body finish applicator device in essentially a horizontal plane;

b) attaching a second portion of said split-body finish applicator device in mated and sealed contact with said bottom portion of said split-body applicator device;

c) substantially blocking and disengaging the air boundary layer in motion with each yarn and venting it to the exterior of said finish applicator device;

d) contacting the yarns with a liquid finish under pressure;

e) substantially disengaging excess finish from the yarns; and f) passing the yarns out of the applicator device with 0.2 wt. % to 5 wt % finish applied to each yarn with a coefficient of variation of 10% or less, and with little or no spray.

21. The method of claim 20 wherein at least 75% of the cross-sectional area of the air boundary layer entrained with each yarn is blocked within and vented from the applicator device.

22. The method of claim 20 wherein the yarn speed is greater than about 5000 m/min.

23. The method of claim 20 wherein the yarn speed is greater than about 8000 m/min.

24. The method of claim 20 wherein the liquid finish contacts the yarn under a pressure of at least about 10 psi (68.9 kPa).

25. The method of claim 20 wherein the liquid finish contacts the yarn under a pressure of at least about 20 psi (138 kPa).

26. The method of claim 20 wherein the liquid finish contacts the yarn under a pressure of at least about 40 psi (276 kPa).

27. The method of claim 20 wherein the liquid finish applied to the yarn is 0.4 wt. % to 4 wt. % with a coefficient of variation of 10% or less.

28. The method of claim 20 wherein the liquid finish applied to the yarn is 0.5 wt. % to 5 wt. % with a coefficient of variation of 10% or less.

29. A method for applying a liquid finish to yarns running at speeds greater than about 3000 m/min and having entrained air boundary layers in motion with each of said yarns comprising the steps of:

a) passing one or more running yarns into a first portion of a split-body applicator device in essentially a horizontal plane through openings individual to each yarn in an exterior wall member of said applicator device;

b) attaching a second portion of said split-body finish applicator device in mated and sealed contact with said first portion of said split-body applicator device;

c) passing each running yarn through a constricted passage within the applicator device;

d) venting the air boundary layer entrained by each running yarn to the exterior of the applicator device;

e) impinging one or more jets of finish liquid supplied under pressure from an external source onto each running yarn within the applicator device;

f) passing each running yarn into two or more sequential chambers defined by one or more walls within the applicator device;

g) draining excess finish liquid from said chambers to an external receptor; and h) passing each yarn out of the last chamber of the applicator device with 0.2 wt. % to 5 wt % finish applied to each yarn with a coefficient of variation of 10% or less, and with little or no spray.

30. The method of claim 29 wherein least 75% of the cross-sectional area of the air boundary layer entrained with each yarn is blocked by the constricted passage within the applicator device.

31. The method of claim 29 wherein the venting of the air boundary layer is aided by applying suction from an exterior vacuum producing means such as a vacuum pump or aspirator.

32. The method of claim 29 wherein the yarn speed is greater than about 5000 m/min.

33. The method of claim 29 wherein the yarn speed is greater than 8000 m/min.

34. The method of claim 29 wherein the liquid finish contacts the yarn under a pressure of at least about 10 psi (68.9 kPa).

35. The method of claim 29 wherein the liquid finish contacts the yarn under a pressure of at least about 20 psi (138 kPa).

36. The method of claim 29 wherein the liquid finish contacts the yarn under a pressure of at least about 40 psi (276 kPa).

37. The method of claim 29 wherein the liquid finish applied to the yarn is 0.4 wt % to 4 wt. % with a coefficient of variation of 10% or less.

38. The method of claim 29 wherein the liquid finish applied to the yarn is 0.5 wt. % to 2 wt. % with a coefficient of variation of about 10% or less.

* * * * *